United States Patent [19]

Shingu et al.

[11] Patent Number: 4,520,611

[45] Date of Patent: Jun. 4, 1985

[54] STRUCTURE OF MULTILAYERED UNIT FOR WINDOWS

[75] Inventors: Tadashi Shingu, Hino; Tadakazu Tsutada, Hachioji; Toshio Nishihara; Nobuo Suzuki, both of Hino, all of Japan

[73] Assignee: Teijin Limited, Osaka, Japan

[21] Appl. No.: 541,474

[22] Filed: Oct. 17, 1983

Related U.S. Application Data

[63] Continuation of Ser. No. 235,548, Feb. 18, 1981, abandoned.

[30] Foreign Application Priority Data

| | | | |
|---|---|---|---|
| Feb. 20, 1980 | [JP] | Japan | 55-19055 |
| Feb. 20, 1980 | [JP] | Japan | 55-19056 |
| Mar. 6, 1980 | [JP] | Japan | 55-27300 |

[51] Int. Cl.[3] ..... E04C 2/54

[52] U.S. Cl. ..... 52/789; 52/790; 52/222

[58] Field of Search ..... 52/171, 172, 78, 222, 52/789, 790, 398, 203; 428/34; 160/378

[56] References Cited

U.S. PATENT DOCUMENTS

| | | | |
|---|---|---|---|
| 82,602 | 9/1868 | Colby | 160/378 |
| 1,099,959 | 1/1914 | Wylie | 160/378 |
| 2,237,566 | 4/1941 | Land | 52/789 |
| 4,170,810 | 10/1979 | Peleg | 52/222 X |
| 4,178,909 | 12/1979 | Goolsby et al. | 126/417 |
| 4,189,880 | 2/1980 | Ballin | 52/222 X |
| 4,193,235 | 3/1980 | Cucchiara | 52/222 |
| 4,226,063 | 10/1980 | Chenel | 52/788 |
| 4,242,386 | 12/1980 | Weinlich | 428/34 |
| 4,432,174 | 2/1984 | Grether et al. | 52/172 X |

FOREIGN PATENT DOCUMENTS

| | | | |
|---|---|---|---|
| 1203877 | 1/1960 | France | 52/790 |
| 86253 | 7/1977 | Japan . | |
| 99635 | 8/1977 | Japan . | |
| 97534 | 1/1978 | Japan . | |
| 62136 | 5/1978 | Japan . | |
| 1444250 | 7/1976 | United Kingdom | 52/790 |

*Primary Examiner*—Donald G. Kelly
*Assistant Examiner*—Naoko N. Slack
*Attorney, Agent, or Firm*—Sherman & Shalloway

[57] ABSTRACT

The present invention provides the structure of a multilayered unit for windows, comprising a plurality of planar members, a flexible film disposed between, and spaced from, two of said planar members, and a stretching member capable of developing elasticity for stretching the flexible film taut by imparting thereto a force in a direction angularly displaced to the film surface of the said flexible film extending at least over that region of said planar members which forms a window, and the planar member present on at least one side of the flexible film being transparent or semi-transparent.

The present invention also provides a multilayered unit for windows and a multilayered window having the same stretching member as in the above structure.

12 Claims, 13 Drawing Figures

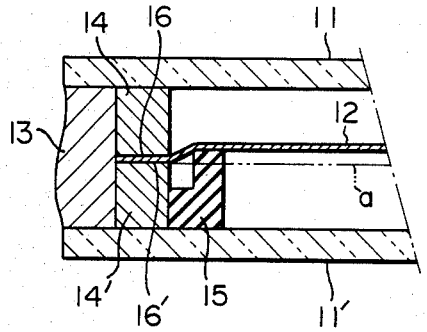
Fig. 1
Fig. 2
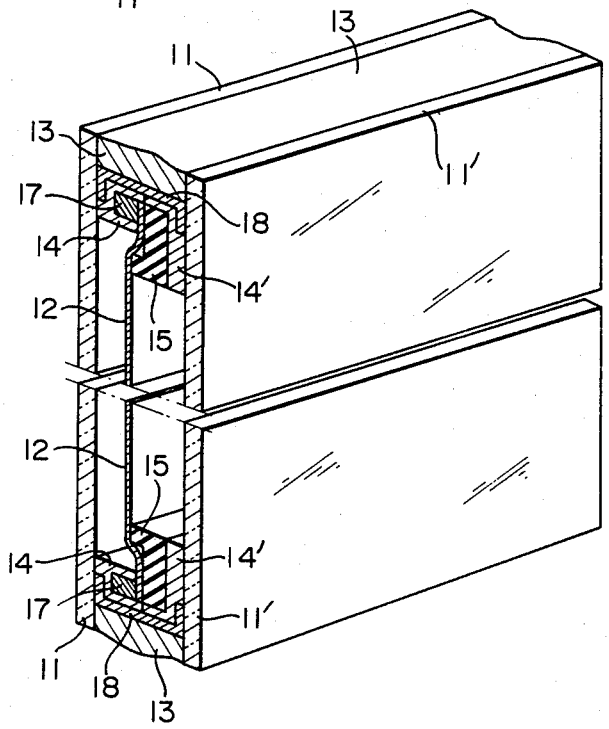
Fig. 3
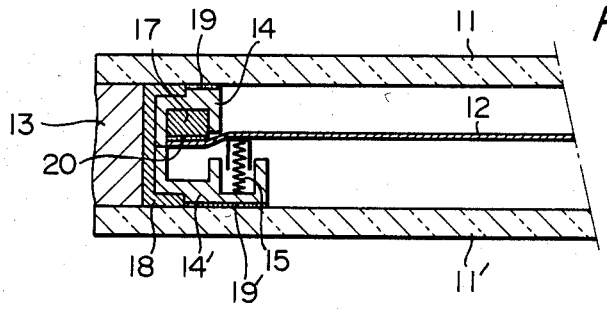

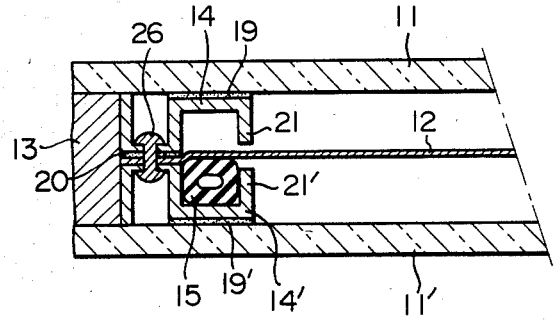
Fig. 10
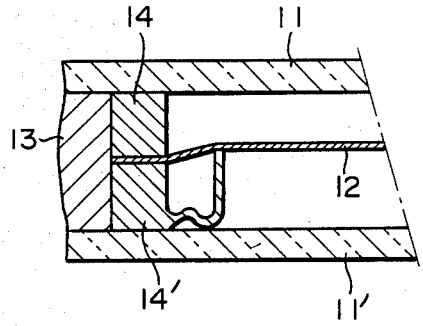
Fig. 11
Fig. 12
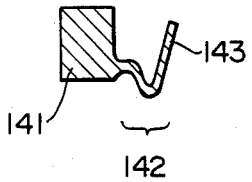
Fig. 13
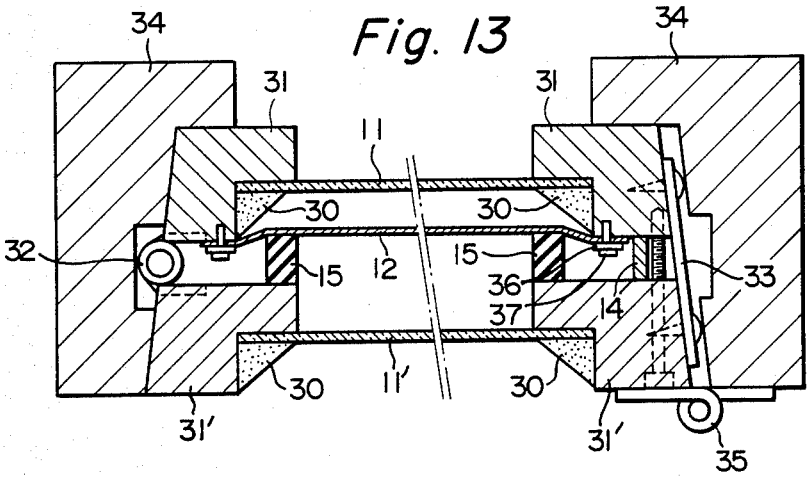

STRUCTURE OF MULTILAYERED UNIT FOR WINDOWS

This application is a continuation of application Ser. No. 235,548, filed Feb. 18, 1980, now abandoned.

This invention relates to the structure of a multilayered unit for windows. More specifically, it relates to a multilayered unit for windows which includes a flexible film stretched taut between two planar members.

Windows of a multilayered structure have been used in the past to insulate a closed warm or cold space from its environment. In view of the importance of energy saving, the need for such multilayered windows is greater nowadays not only in areas of severe natural environments, but also in areas of relatively mild environments or in environments subject to extensive human influences in various industrial fields.

Many of conventional multilayered windows in actual use comprise a plurality of glass sheets arranged in spaced-apart relation, and can fully insulate a closed space from its environments. In order, however, to increase their heat insulating effect, the number of glass sheets in the multilayered windows must be increased, and this presents a problem of cost increase in that window frames supporting the windows must be reinforced and the thickness of the window frames must be increased.

In an attempt to solve this problem in multi-layered windows including glass sheets, a double window structure in which at least one of the windowpanes is replaced by a plastic material (see, for example, Japanese Laid-Open Patent Publication No. 86253/77), and multi-layered window structure in which one of the windowpanes is replaced by a film (see, for example, Japanese Laid-Open Patent Publication No. 99635/77) have been suggested. Although these window structures give a solution to the problem arising from the weight increase of multilayered windows including glass sheets as windowpanes, they fail to ensure greater heat-insulating effects than the multi-layered glass windows because they do not go beyond changing of the windowpane material.

There is also known a soundproof window of the structure in which a plastic sheet is disposed in spaced-apart relation between two sheets of glass (see Japanese Laid-Open Patent Publication No. 97534/78). Also proposed was a heat-insulating window in which a light-shielding windable film is provided in spaced-apart relationship between two sheets of glass (see Japanese Laid-Open Patent Publication No. 62136/78).

No proposal, however, seems to have been made about a multilayered window of the structure in which between two sheets of glass is disposed in spaced-apart relation a flexible film which is fixedly stretched taut maintaining a substantially constant distance from the glass sheets. This is presumably because a suitable stretching means for the flexible film is difficult to develop. To permit correct vision without image distortion, the flexible film should be stretched taut such that no localized loosening, wrinkling, etc. occur during the stretching operation and that such localized loosening, wrinkling, etc. due to heat distortion of the film with the passage of time after stretching can also be avoided.

Japanese Laid-Open Patent Publication No. 99635/77 cited above relates to multilayered window having a different structure from the one in which a flexible film is disposed between two glass sheets, but discloses means for stretching a flexible film taut which consists of a pre-deformed elastic member mounted as a support for the film. It is noted that stretching of the flexible film by the elastic member disclosed in this patent document relies on its elastic property which acts on the surface of the flexible film. Investigations of the present inventors show, however, that such a stretching means is not sufficient to absorb fully heat deformation caused by temperature differences occuring with time after the strectching and to avoid the consequent occurrence of loosening, wrinkling, etc. Loosening, wrinkling, etc. of the film which occur with passage of time after the stretching of the film frequently become a serious defect in the structure of a multilayered window, and this defect is non-remediable in the case of a multilayered window constructed as a unit in which the opening and closing of the two glass sheets are difficult.

It is an object of this invention therefore to provide the structure of a multilayered unit for windows comprising a plurality of planar members and a flexible film disposed between, and spaced away from, two of the planar members and stretched taut such that loosening, wrinkling, etc. may not occur during and after the stretching.

Another object of this invention is to provide a multilayered unit for windows and a multilayered window unit which include the aforesaid structure.

Other objects and advantages of the invention will become apparent from the following description.

According to the broadest aspect of this invention, the objects and advantages of this invention are achieved by the structure of a multilayered unit for windows, comprising a plurality of planar members, a flexible film disposed between, and spaced away from, two of said planar members, and a stretching member capable of developing elasticity for stretching the flexible film by imparting thereto a force in a direction angularly displaced to the film surface; said flexible film extending at least over that region of said planar members which forms a window, and the planar members present on at least one side of the flexible film being transparent or semi-transparent.

The structure of a multilayered unit for windows in accordance with the invention is characterized by including a stretching member capable of developing elasticity for stretching the flexible film by imparting to the flexible film a force tending in a direction angularly displaced to the film surface. To impart a force in a direction angularly displaced to the surface of the film means that the direction of a force exerted on the film from outside does not exist on the film surface. Accordingly, such a force at least has a vector component in a direction at right angles to the film surface. When the film is stretched taut by imparting such a force, loosening, wrinkling, etc. of the film with the passage of time can be prevented in contrast to the case of exerting a force in a direction which exists on the film surface. Moreover, it is very easy to stretch the film taut without causing loosening, wrinkling, etc. during the stretching operation.

The planar member, as referred to in the present invention, denotes a member which extends longitudinally and transversely and has a small thickness for its longitudinal and transverse dimensions but which when fixed at their four peripheral sides, does not easily undergo breakage or deformation. A plate-like member is an example. It may be made of an inorganic or organic material. Preferred materials for the planar member are glass, acrylic resins, vinyl chloride resins and polycarbonate resins. Glass sheets generally have excellent chemical or physical durability, and are used preferably when such properties are required.

Usually, the planar member used in this invention has a thickness of 0.1 mm to 20 mm, preferably 0.5 mm to 10 mm, more preferably about 1 mm to about 10 mm, especially preferably about 2 mm to about 6 mm.

In the structure of a multilayered unit for windows in accordance with this invention, the planar members present on at least one side of the flexible film should be transparent to such an extent that the presence of the flexible film can be viewed and ascertained therethrough. That the planar members are transparent or semi-transparent in this invention means that at least the presence of the flexible film can be viewed and ascertained with the naked eyes through the planar members.

By using the transparent or semi-transparent planar members in the structure of a multilayered unit for windows of the invention, the freedom of the flexible film from loosening, wrinkling, etc. can be ascertained on at least one side of the structure of a multilayered unit for windows in the invention.

The flexible film, as referred to in this invention, denotes a film which extends longitudinally and transversely and has an extremely small thickness for its longitudinal and transverse dimensions, and which is not supported, or upon application of an external force, can be easily changed from its two-dimensional state to a three-dimensional state (e.g., a curved configuration). In other words, the term "film" is used in an ordinary sense in this invention. For example, the film has a thickness of 2 to 500 microns, preferably 4 to 200 microns, especially preferably 10 to 100 microns.

The flexible film in this invention may be transparent, semi-transparent or non-transparent. Semi-transparent or non-transparent flexible films may be advantageously used when it is not necessary to view an outside object through the multilayered structure of this invention, or when it is desired to prevent viewing of an inside object through the multilayered structure. Transparent flexible films can be used in multilayered structures for windows which permit vision. These films may be colored, or may be a single film or a laminated film produced by laminating such single films. Or the films may be subjected to treatments for imparting the ability to reflect light or heat. Methods for producing such films are well known per se to those skilled in the art.

The flexible films used in this invention are preferably produced from materials which consist wholly or basically of polyolefins such as polyethylene and polypropylene, polyvinyl halides such as polyvinyl chloride, polyvinylidene chloride and polyvinylidene fluoride, aromatic polyesters such as polyethylene terephthalate, polytetramethylene terephthalate and polyethylene naphthalate, aromatic polycarbonates derived from bisphenols such as bisphenol A as a diol component, and polyamides such as poly(epsilon-capramide) and polyhexamethylene adipamide.

The flexible films prepared from materials consisting wholly of the above-exemplified polymers are used after monoaxial or biaxial stretching. A biaxially oriented film of polyethylene terephthalate, and a polyolefin film such as a polypropylene or polyethylene film are advantageously used in this invention because the former has high strength and is readily available, and the latter exhibits unique properties with regard to heat waves.

According to this invention, there can be provided a multilayer unit for windows which comprises two planar members and one flexible film capable of reflecting heat waves disposed between them in spaced-apart relationship. This structure shows equivalent heat wave-shielding property to a quadruple window structure consisting of four glass sheets.

A film composed of a flexible film made of such a material as exemplified above and, formed on one or both surfaces thereof, a thin layer of at least one member selected from metal elements, metal alloys and metal oxides or a combination of it with a dielectric material having a high refractive index, can also be used.

Examples of the metal elements are gold, silver, copper and aluminum, and examples of the metal alloys are a gold-silver alloy, a silver-copper alloy, a gold-copper alloy, a platinum-silver alloy, a platinum-silver-copper alloy, and a gold-silver-copper alloy.

Examples of the metal oxides are indium trioxide ($In_2O_3$), tin dioxide ($SnO_2$), and cadmium tin oxide ($Cd_2SnO_4$).

The dielectric material having a high refractive index is selected from organic or inorganic materials having a refractive index of usually at least 1.4, preferably at least 1.6, more preferably at least 1.8. Examples include titanium oxide, poly(meth)acrylonitrile, bismuth oxide, zinc sulfide, tin oxide, indium oxide and zirconium oxide.

A flexible film having a thin layer of the metal oxide formed thereon, and a flexible film having a thin layer of the metal and a thin layer of the dielectric material having a high refractive index have the ability to reflect heat waves, and despite having such a thin layer, show good transparency. The thin metal oxide layer preferably has a thickness of about 2000 to about 4000 Å. The thin layer of the metal element preferably has a thickness of about 50 to about 600 Å, especially about 75 to about 200 Å. The thickness of the thin layer of the dielectric material is preferably about 40 to about 600 Å, especially about 50 to about 400 Å.

In a flexible film prepared by forming a thin layer having the ability to reflect heat waves as exemplified above on one surface of a film of a polyolefin, particularly polyethylene or polypropylene, heat waves which pass through the film layer of such a material are not absorbed in the film layer but are reflected at the surface of the thin layer to a great extent because the film material has little ability to absorb heat waves, i.e. infrared rays. Such a flexible film consisting of a film of such a material and, formed on one surface thereof, a thin layer having the ability to reflect heat waves, shows almost an equivalent ability to reflect heat waves as a flexible film composed of a film of any material and the thin layer formed on both surfaces thereof. It will be readily appreciated that formation of the thin layer only on one surface of the film is advantageous in the forming operation and the performance of the flexible film produced over the formation of the thin layer on both surfaces of the film.

Formation of such a thin layer on the flexible film is effected by vacuum deposition method or a sputtering method, etc. Such methods are described, for example, in Thin Film Processes (by J. L. Vossen, W. Kern, Academic Press 1978).

A flexible film having a roughened surface and a flexible film having a thin layer of a metal such as aluminum formed on one or both surfaces thereof may also be used. These films have lower heat wave-reflecting ability, but better ability to shield light, than the aforesaid films having a thin film of a metal oxide formed thereon.

The multilayered structure for windows in accordance with this invention includes a plurality of the aforesaid planar members and the aforesaid flexible film disposed between, and spaced apart from, two of the planar members. The flexible film may be present in at least one of the spaces formed between any two of a plurality of planar members whose surfaces are normally located substantially parallel to each other. For example, when the multilayered structure includes three planar members, the flexible film may be present in both of the spaces formed by the three planar members, or in only one of them.

The flexible film should extend at least over that region of the planar members which forms a window because the purpose of providing the flexible film is intrinsically to obtain a heat insulating effect through that region of the planar members which constitutes a window.

The planar members present on at least one side of the film should be transparent or semi-transparent. This means that all of the planar members present on one side of the flexible film should be transparent or semi-transparent. When all of the planar members present on both sides of the flexible film are non-transparent, the presence of the flexible film is not perceptible through the planar membranes present on either side, and therefore, there is no significance in stretching the flexible film taut. If all of the planar members present on one side of the flexible film are transparent or semi-transparent, those present on the opposite side of the film may be transparent, semi-transparent or non-transparent.

The multilayered unit for windows in accordance with this invention includes a stretching member capable of developing elasticity for stretching the flexible film taut. The stretching member stretches the flexible film by imparting thereto a force in a direction angularly displaced to the film surface.

The stretching member may be made of an elastic material and therefore can develop elasticity based on the elasticity of the material. Or it may be a member which is made of a substantially non-elastic material but which can develop elasticity owing to its configuration. Such a material and a configuration capable of developing elasticity are well known to those skilled in the art, and will also be apparent from the following description.

The stretching member displaces the whole or a part of a primary fixing plane of the flexible film (i.e., that plane of the flexible film which would be defined when it is fixed without using the stretching member) in a direction perpendicular to the film surface. The stretching member imparts a force (pushing or pulling force) tending in direction angularly displaced to the film surface, whereby the film surface is displaced in the perpendicular direction as stated above, and as a result, the film is stretched taut without loosening, wrinkling, etc. Accordingly, the points of contact between the stretching member and the flexible film stretched by the stretching member exist externally of the primary fixing plane of the flexible film.

The stretching member is arranged in contact with the four peripheral edges of the flexible film so that a substantially equal force is exerted on the four peripheral edges of the film. For example, the stretching member may be disposed in contact with the entire four peripheral edges of the flexible film, or on two opposite peripheral edges of the film. In this case, each of the stretching members may extend along the entire length of one side of the film, or may be cut here and there along the length of one side of the film. Alternatively, the stretching members may be arranged only at the four corners of the flexible film.

In the structure of the multilayered unit for windows in accordance with this invention, the flexible film may be fixed so that it is located at a given position relative to the planar members. It may be fixed to a sealing member for sealing two planar members along their entire peripheral edge portion, or to a spacer provided separately from the sealing member for defining a space between two planar members, or to a film support provided separately from the sealing member and or the spacer. In other words, the sealing member, spacer or film support for fixing the flexible film are also arranged such that they are located at fixed positions relative to the planar members.

The stretching member imparts the aforesaid force to the flexible film fixed at the predetermined position relative to the planar members, thereby stretching the flexible film taut. Thus, the stretching member is built in the multilayered unit of this invention so that it displaces the flexible film fixed as above in a direction perpendicular to the primary fixing plane of the film. For example, it can be built in the multilayered unit by securing it to the fixed sealing member, spacer or film support, the planar member, or flexible film. When the stretching member is secured to the sealing member, spacer, film support, or planar member, it desirably makes slidable contact with the flexible film. When the stretching member is fixed to the flexible film, it desirably makes slidable contact with the planar members.

Now, referring to the accompanying drawings, the present invention will be described in greater detail. In these drawings, elements showing the same functions are designated by the same reference numerals.

FIG. 1 is a partial sectional view of one embodiment of the structure of a multilayered unit of the present invention;

FIGS. 2 to 11 are partial sectional views of other embodiments of the structure of a multilayered unit of the present invention;

FIG. 12 is a side elevation of one example of the stretching member used in this invention; and FIG. 13 represents a partial sectional view of one example of the multilayered window unit in accordance with this invention.

Figure 4:
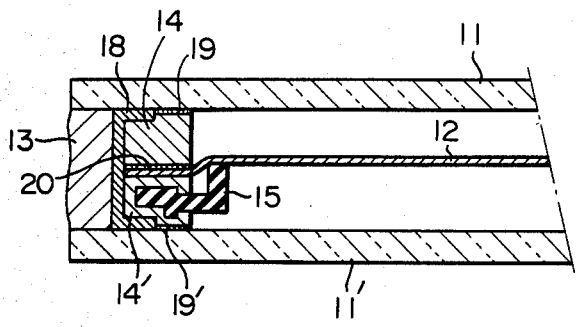

It should be understood that the relative sizes of the members in these drawings are given for convenience of illustration, and do not represent their actual relative sizes.

In FIG. 1, the structure of a multilayered unit of this invention includes two planar members (e.g., glass sheets) 11 and 11' held at a fixed interval by means of spacers 14 and 14', the entire peripheral edges of the planar members being sealed by a sealing member 13.

A flexible film 12 is fixed, for example, by an adhesive to a spacer 14 and/or a spacer 14' at its surface 16 and/or 16'. The spacers 14 and 14' are fixed to a sealing member, and therefore, the flexible film 12 is fixed so that it occupies a fixed position relative to the planar members 11 and 11'. The reference letter a represents a primary fixing plane of the flexible film 12 which the flexible film would take in the absence of a stretching member 15. The stretching member 15 is bonded, for example, by an adhesive to the spacer 14' and/or the planar member 11' and imparts a force tending to push the flexible film upwardly in FIG. 1 to displace the flexible film from the primary fixing plane a to the plane of the flexible film 12 shown in FIG. 1, thereby stretching it taut.

With reference to FIG. 2, the structure of a multilayered unit in accordance with this invention includes two planar members 11 and 11' spaced apart from each other by spacers 14 and 14' at a fixed distance with their peripheral edge portions being sealed up by a sealing member 13. A stretching member 15 is fitted between the spacers 14 and 14', or is fixed to the spacer 14' by bonding. The flexible film 12 is fixed to a film support 17 by bonding. The film support 17 is engaged with the inside of the spacer 14 so as to permit passage of the flexible film 12 between the spacer 14 and the stretching member 15. The spacers should be made of such a material and have such a configuration which scarcely undergoes deformation in order to maintain a fixed distance between the planar members. The film support 17 may be of any material and configuration. The spacers 14 and 14' are firmly fixed at their outside by a fixing member 18.

FIG. 3 shows the structure of a multilayered unit of this invention in which a member which develops elasticity owing to its spring-like configuration is used as the stretching member 15. The spring-like elastic member is covered with a cap or the like at the point of contact with the flexible film so as not to damage the film. The reference numerals 19 and 19' respectively represent the site of bonding between the planar member 11 and the spacer member 14 and the site of bonding between the planar member 11' and the spacer member 14', and the reference numeral 20 represents the site of bonding between the flexible film 12 and the film support 17.

FIG. 4 shows the structure of the multilayer structure of this invention in which the spacer member 14' has a space inside into which the stretching member 15 is fitted. In the illustrated structure, no spacer nor film support is used, and the flexible film 12 is directly fixed to the spacer member 14 through the site of bonding 20.

Figure 5:
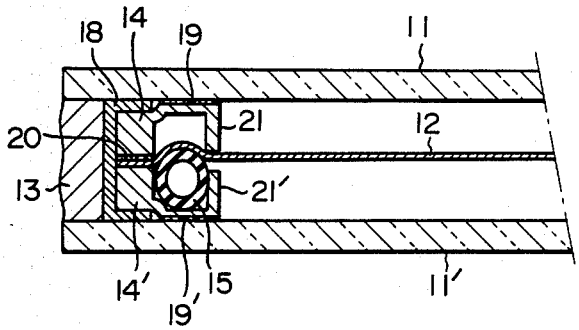

FIG. 5 shows a structure in which the spacer members 14 and 14' have spaces opposing each others, and the stretching member 15 is fitted into the space of one spacer member 14'. The stretching member is a hollow cylindrical member made on an elastic material such as rubber, and is shielded over its nearly entire contour by shield portions 21 and 21' of the spacer members 14 and 14'. The shielded stretching member is shielded from sunlight, for example, and is thus protected from light degradation which results in a loss of elasticity. As in FIG. 4, the flexible film 12 is fixed to the spacer member 14 through the bonding site 20, and is stretched by the stretching member 15 by undergoing an upwardly tending force.

Figure 6:
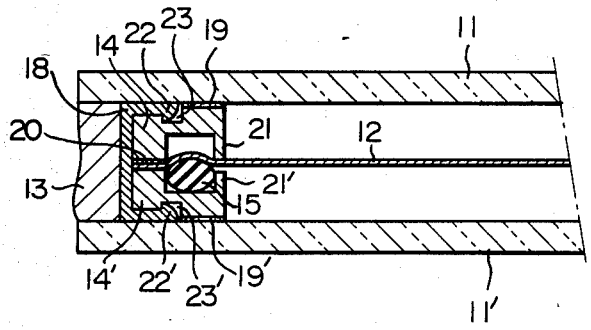

FIG. 6 illustrates a structure in which the stretching member 15 is shielded by shield or portions 21 and 21' as in FIG. 5. The stretching member 15 is a round rod-like member made of a relatively flexible elastic material. In the drawing, the spacer members 14 and 14' respectively have recesses 23 and 23' opposite to the planar members 11 and 11' respectively. Claw-like portions 22 and 22' of the fixing member 18 are fitted into these recesses 23 and 23' respectively. The spacer members 14 and 14' are fixed firmly as a unit by this fixing member.

Figure 7:
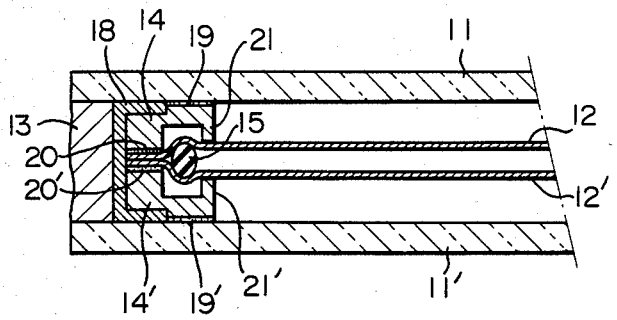

FIG. 7 shows another embodiment of the structure of the multilayered unit of this invention in which two flexible films exist between two planar members. The two flexible films are disposed apart from each other and from the planar members.

The stretching member 15 is located in a space defined by the spacer members 14 and 14' and shielded by the shields 21 and 21' between a flexible film 12 fixed to the spacer member 14 through the site 20 of bonding and a flexible film 12' fixed to the spacer member 14' through the site 20' of bonding. The stretching member 15 stretches the flexible films 12 and 12' by imparting an upwardly directed force to the flexible film 12 and a downwardly directed force to the film 12' in the drawing.

Figure 8:
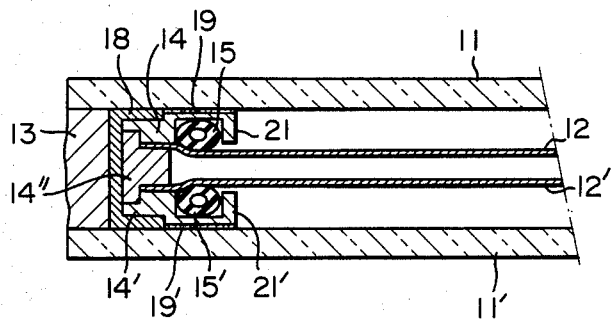

FIG. 8 shows another embodiment of the multilayered structure of this invention in which two flexible films are present between two planar members as in FIG. 7. In FIG. 8, the spacer consists of members 14, 14' and 14'' which are fixed integrally by the fixing member 18. The spacer members 14 and 14' respectively have shield portions 21 and 21', and include stretching members 15 and 15' respectively in spaces formed in the spacer members 14 and 14'. The flexible films 12 and 12' are fixed physically without using an adhesive between the spacer members 14 and 14'' and between the spacer members 14'and 14'', or are chemically fixed by using an adhesive to any one of these members. The flexible film 12 is subjected to a downwardly directed force by the stretching member 15 and the flexible film 12' is subjected to an upwardly directed force by the stretching member 15' in the drawing.

Figure 9:
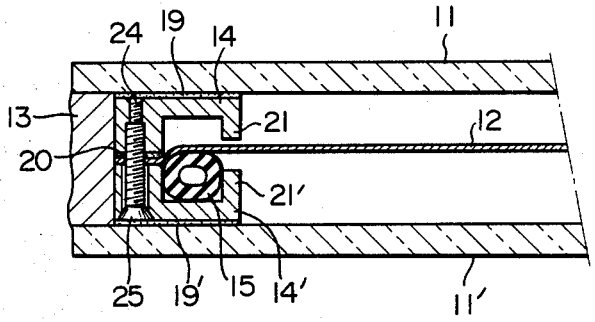

FIG. 9 shows still another embodiment of the structure of the multilayered unit of this invention in which the spacers 14' and 14' are fixed tightly as an integral unit by means of screws 24 and 25. The screw 25 extends through the spacer member 14' and reaches the spacer member 14, and the screw 24 extends through the space member 14 and is threadably fitted into the screw 25.

In FIG. 10, the spacer members 14 and 14' are fixed integrally by means of a screw 26.

In the structures illustrated in FIGS. 9 and 10, the screws, 24, 25 and 26 have an equivalent function to the fixing member shown at 18 in other embodiments.

FIG. 11 shows a further embodiment of the multilayer structure of this invention in which a stretching member is formed integrally with a spacer. The spacer portion 14', before being mounted to the structure of this invention, consists of a portion 141 functioning as a spacer, a portion 142 capable of developing elasticity and a portion 143 for transmitting the generated force to the flexible film. The spacer portion 14' may be made of a substantially non-elastic material such as a thermoplastic resin, a thermosetting resin or a metal. When the spacer portion 14' is incorporated in the structure shown in FIG. 11, the portion 142 capable of developing elasticity is deformed elastically, and the force generated is transmitted to the flexible film 12 through the portion 143, thereby stretching the flexible film taut.

According to this invention, therefore, there is provided a multilayered unit for windows having the aforesaid structure which comprises planar members, flexible films and stretching members.

Specifically, the multilayered unit for windows in accordance with this invention comprises a plurality of planar members; at least one flexible film disposed between, and spaced from, two of the planar members; a stretching member capable of developing elasticity for stretching the film taut by imparting thereto a force in a direction angularly displaced to the film surface; a spacer defining a space formed between opposing planar members; and a sealing member for sealing up spaces formed by the planar members along the entire peripheral edge portions of the planar members.

As stated hereinabove, in the multilayered unit of this invention, the entire peripheral edge portions of the planar members are sealed up by the sealing member.

The spaces formed by two opposing planar members and the flexible film therebetween may, or may not, communicate with each other. Since in the structure of the present invention, the force imparted by the stretching member is angularly displaced with respect to the film surface, it is possible to use a stretching member capable of imparting a greater force to the film than in the case of imparting to the film a force tending in the direction of the film surface. This means that even when a force caused by an external factor such as a rise in temperature is exerted on either surface of the flexible film in the structure in which the aforesaid spaces do not communicate each other, the flexible film can still be maintained taut in resistance to such an external force in accordance with this invention. When the aforesaid spaces formed by two opposing planar members and the flexible film therebetween communicate with each other, the increase of pressure which occurs in one space owing to a rise in temperature is averaged with the pressure in another space. Accordingly, any force ascribed to an external factor acts equally on both surfaces of the flexible film. Communication between the spaces can most conveniently be effected by forming apertures in the flexible film (at corners not perceptible with the naked eyes). Or holes leading to both spaces may be provided in the spacers, etc.

In place of air, carbon dioxide, $SF_2$, or an inert gas such as argon, krypton or nitrogen may be filled into the spaces sealed up by the sealing member. Filling of argon, krypton, $SF_6$ or carbon dioxide further improves the heat insulating property of the multilayered window.

The sealing member may be made of materials customarily used for multilayered glass windows, such as polysulfide polymers, silicone polymers and butyl rubbers. The spaces in the multilayered structure of this invention may also contain a desiccant such as silica gel and molecular sieves which are customarily used.

According to this invention, there is also provided a multilayered window unit comprising a plurality of planar members supported on window frames, and a flexible film secured to the window frames or the planar members.

The multilayered window unit of this invention specifically comprises a plurality of planar members supported on window frames, a flexible film disposed between, and spaced from, two of the planar members, and a stretching member capable of developing elasticity for stretching the flexible film taut by imparting thereto a force in a direction angularly displaced to the film surface.

The multilayered window unit has the window frames which are constructed in such a structure that when the unit is mounted on a building, it constitutes a window.

FIG. 13 illustrates one example of the multilayered window unit of this invention. With reference to FIG. 13, planar members 11 and 11', such as transparent glass sheets, are secured to window frames 31 and 31' respectively by means of a putty 30. The multilayered window unit of this invention can be opened and closed by a rotating means 32, and is normally fixed in place by a window frame fixing means 33 and secured to an external frame 34 by a fixing means 35. The clearance between the planar members 11 and 11' is defined by a spacer 14. A flexible film 12 fixed to the window frames 31 by a film fixing means 37 through a film slippage arresting member 36 is stretched taut by a stretching member 15 fixed onto the window frames 31', for example by bonding, which imparts a force tending upwardly in the drawing.

Although the multilayered window unit shown in FIG. 13 is of a so-called linked window type in which the window frames on one side can be opened and closed as required, it will be readily understood that the multi-layered window unit of this invention is not limited to this type alone.

The multilayered structures for windows in accordance with this invention including the multilayered unit for windows, and the multilayered window unit) have very good insulating effects, and even when they are used over a long period of time, the flexible films do not get loosened or wrinkled.

For example, a multilayered unit for windows in accordance with this invention comprising two sheets of glass and a flexible polypropylene film having a heat wave-reflecting thin layer formed on one surface thereof which is disposed between, and spaced from, the glass sheets has a heat-transfer coefficient ($Kcal/m^2.hr.deg$) of less than about 1.5, and particularly less than about 1.2. The superior heat insulating property of the structure of this invention is clearly demonstrated by this in view of the fact that an ordinary glass window and an ordinary double glass window have a heat-transfer coefficient of about 5.4 and about 3.0, respectively.

The structure of the multilayered unit for windows in accordance with this invention can be advantageously applied to windows in general houses, buildings, vehicles, ships, aircraft, etc. or to viewing windows of refrigerator showcases, showwindows, solar energy heaters, heat-generating units, etc.

What we claim is:

1. The structure of a multilayered unit for windows, comprising a plurality of planar members; at least one flexible film disposed therebetween and spaced from two of the planar members; spacers solely defining the clearance between opposing planar members; and a sealing member for sealing the spaces defined by the planar members at substantially their entire peripheral edge portions said flexible film extending at least over that region of said planar members which forms a window, and the planar members present on at least one side of the flexible film being transparent or semi-transparent, characterized in that the structure includes a resilent stretching member separate from said spacers for stretching the flexible film taut by imparting thereto a force having at least a vector component thereof acting at right angles to the plane of the film, so as to tend to push said film away from said stretching member, each of the spacers opposing each other on each side of said film having a space formed therein which faces the flexible film and further wherein the stretching member is located in at least one of said spaces and is substantially shielded from sunlight by at least one of said spacers.

2. The structure of claim 1 wherein the stretching member slidably contacts the flexible film.

3. The structure of claims 1 or 2 wherein points of contact of the stretching member with the flexible film at which the former imparts a force to the latter exist externally of a primary fixing plane of the flexible film.

4. The structure of claim 1, wherein the flexible film has the ability to reflect heat waves.

5. The structure of claim 4 wherein the flexible film is transparent.

6. The structure of claim 1 wherein the spaces defined by the two planar members and the flexible film therebetween communicate with each other.

7. The structure of claim 1 wherein the spacers fix the flexible film.

8. The structure of claim 7 wherein the stretching member is fitted into the space of only one of said spacers.

9. The structure of claim 8 wherein the spacer have shielding portions whereby the stretching member which is fitted into a said space is shielded over nearly its entire contour.

10. The structure of claim 1 which further comprises a film supporting fixing the flexible film.

11. The structure of claim 10 wherein the film support is an engagement with a spacer.

12. The structure of a multilayered unit for window, comprising a plurality of planar members, a flexible film disposed between, and spaced from, two of said planar members which are separated by spacer means, and a stretching member formed integrally with the spacer means and made of an elastic material and having an elasticity sufficient to impart to the flexible film a force in a direction angularly displaced to a primary fixing plane of the flexible film and to stretch the flexible film taut, said primary fixing plane being defined as a plane of the flexible film when the flexible film is fixed without using the stretching member; the flexible film extending at least over that region of said planar members which forms a window, and a planar member present on at least one side of the flexible film being from transparent to semi-transparent so that said flexible film can be viewed therethrough.

* * * * *